US007017380B2

(12) United States Patent
Schmauder et al.

(10) Patent No.: US 7,017,380 B2
(45) Date of Patent: Mar. 28, 2006

(54) BENDING ASSEMBLY FOR BENDING MACHINE

(75) Inventors: Frank Schmauder, Metzingen (DE); Winfried Richter, Aichtal-Grötzingen (DE)

(73) Assignee: Trumpf Rohrtechnik GmbH &Co. KG, Reutlingen-Mittelstadt (DE)

( * ) Notice: Subject to any disclaimer, the term of this patent is extended or adjusted under 35 U.S.C. 154(b) by 423 days.

(21) Appl. No.: 10/619,075

(22) Filed: Jul. 11, 2003

(65) Prior Publication Data

US 2004/0065131 A1 Apr. 8, 2004

(30) Foreign Application Priority Data

Jul. 13, 2002 (EP) ..... 02015759

(51) Int. Cl.
*B21D 9/05* (2006.01)

(52) U.S. Cl. ..... 72/149; 72/150; 72/157; 72/159; 72/217; 72/306; 72/307; 72/388

(58) Field of Classification Search ..... 72/149, 72/150, 157, 159, 217, 306, 307, 388
See application file for complete search history.

(56) References Cited

U.S. PATENT DOCUMENTS

| | | | | |
|---|---|---|---|---|
| 5,481,891 | A | 1/1996 | Sabine | |
| 5,784,913 | A * | 7/1998 | Bhandari | 72/149 |
| 5,992,210 | A * | 11/1999 | Blurton-Jones | 72/702 |
| 6,345,525 | B1 | 2/2002 | Bruyas et al. | |

FOREIGN PATENT DOCUMENTS

| | | |
|---|---|---|
| WO | WO 87/00096 | 1/1987 |

* cited by examiner

*Primary Examiner*—Derris Banks
*Assistant Examiner*—Hung C Le

(57) ABSTRACT

A bending assembly on a bending machine for the bending of rod and/or bar-shaped workpieces (8) includes a bending tool (10) and a bending drive unit (11) with a swivel arm (21) and a bending-drive motor (22). The bending tool (10) has at least one workpiece thrust block (12, 13), and the swivel arm (21) has at least one thrust pad (17, 18). The bending-drive motor (22) rotates the swivel arm (21) with the thrust pad (17, 18) around a bending axis (14) that extends in the transverse direction of the workpiece. The workpiece is bent when the thrust pad (17, 18) forces it against and around the associated workpiece thrust block (12, 13). The shaft of the bending drive motor (22) extends parallel to the bending axis (14), and both ends of the shaft are drive-connected to the swivel arm (21).

10 Claims, 3 Drawing Sheets

BENDING ASSEMBLY FOR BENDING MACHINE

BACKGROUND OF THE INVENTION

This invention relates to the bending assembly of a bending machine for bending rod- and/or bar-shaped workpieces and especially pipes.

Some bending assemblies employ a bending tool and a bending drive unit with a swivel arm and a bending drive motor, with the bending tool featuring at least one workpiece thrust block and at least one thrust pad on the swivel arm, whereby the bending drive motor can rotate the swivel arm with the thrust pad around a bending axis extending in the transverse direction of the workpiece so that, when the swivel arm with the thrust pad is rotated, the workpiece can be bent as it is forced by the thrust pad against the corresponding thrust block.

A bending system of this type, operating by the roll-and-stretch bending principle, has been disclosed in DE-A-40 10 445. In the prior art design an electric bending-drive motor is housed inside a bending bench that protrudes from a machine base and is equipped at its free end with a bending tool. The bending tool includes two bending dies that sit on the two opposite ends of a spindle. The neutral geometric axis of this spindle, i.e., the bending axis, extends in the transverse direction of the workpiece. Also connected to the spindle is a swivel arm which, when the spindle with the bending dies is rotated, can swivel around the bending axis. Clamping jaws that cooperate with the bending dies can be moved on the swivel arm in the transverse direction of the workpiece. For bending the workpiece, the bending dies and the swivel arm are driven by the electric bending-drive motor whose shaft is connected by a gear system to a transmission shaft that extends in the transverse direction of the bending axis. A transfer transmission in the form of a bevel gear drive transmits the rotary movement of the transmission shaft to the spindle that is positioned concentric with the bending axis and supports the bending dies as well as the swivel arm.

This earlier bending drive design and thus the prior art bending system as a whole is relatively bulky, which is especially true with machines providing a substantial transverse bending torque and requiring a correspondingly massive bending-drive motor.

It is the objective of this invention to provide a novel bending assembly that is capable of handling even large transverse bending torques within a compact configuration.

SUMMARY OF THE INVENTION

It has now been found that the foregoing and related objects may be readily attained in a bending assembly of a bending machine (1) for bending rod and/or bar-shaped workpieces (8), comprising a bending tool (10) and a bending drive unit (11) including a swivel arm (21) and a bending-drive motor (22). The bending tool (10) includes at least one workpiece thrust block (12, 13) and, at least one thrust pad (17, 18) on the swivel arm (21). The bending-drive motor (22) is operable to rotate the swivel arm (21) with the thrust pad (17, 18) around a bending axis (14) extending in the transverse workpiece direction. As a result, the workpiece, forced by the thrust pad (17, 18) against the associated workpiece thrust block (12, 13), can be bent by rotating the swivel arm (21) with the thrust pad (17, 18) around the workpiece thrust block (12, 13). The bending-drive motor (22) has a motor shaft (27) which extends parallel to the bending axis (14) and is drive-connected at both shaft ends (28, 29) to the swivel arm (21).

Preferably, the motor shaft (27) of the bending-drive motor (22) extends coaxially with the bending axis (14), and the bending-drive motor (22) is a torque motor. Both ends (28, 29) of the motor shaft (27) of the bending-drive motor (22) are individually drive-connected to the swivel arm (21) by a gear unit (23, 24).

In one embodiment, at least one workpiece thrust block (12, 13) of the bending tool (10) is in the form of a bending die and is drive-connected to the motor shaft (27) of the bending-drive motor (22) and can thus be rotated around the bending axis (14), the bending tool (10) is equipped with at least one thrust pad (17, 18) in the form of a clamping jaw mounted in the transverse workpiece direction on the swivel arm (21). Thus, the workpiece can be clamped between the bending die and the associated clamping jaw and bent, while clamped, by rotation of the bending die and of the swivel arm with the clamping jaw around the bending die.

Desirably, both shaft ends (28, 29) of the motor shaft (27) of the bending-drive motor (22) are respectively drive-connected to at least one bending die which can be rotated around the bending axis (14), and the bending dies on the respective shaft ends (28, 29) are positioned in the direction of the bending axis (14) on either side of the bending-drive motor (22). Each die cooperates with a clamping jaw that is movable on the swivel arm (21) in the transverse direction of the workpiece, and the bending assembly (3) can be rotated around an axis (30) that extends in the longitudinal direction of the workpiece. As a result, one of the bending dies located on either side of the bending-drive motor (22) and its associated clamping jaw can be selectively moved into a working position.

Aligning the motor shaft of the bending-drive motor parallel to the bending axis dispenses with an otherwise necessary transfer transmission which takes up space. Since the bending-drive motor has two power take-off sides and the swivel arm connects to both power take-off sides, the motor torque is transferred to the swivel arm at several distributed points. Overall, this results in a unit that, in spite of its compactness, is superbly powerful while at the same time its small dimensions and minimal weight give it optimal movability for instance when aligning the bending tool relative to the workpiece to be processed.

The shaft of the bending-drive motor extends coaxially with the bending axis. Torque motors, i.e. low-speed electric drive motors, are of a low profile yet can deliver even high torques. Interpositioning gear systems between the power take-off sides of the bending-drive motor and the swivel arm permits for simple adaptation of the bending-drive configuration to the respective requirements of a given application. When used in combination with low speed bending-drive motors, a long lived drive assembly is attainable.

The bending assembly that operates by the roll and stretch bending principle takes advantage of the benefits offered by the bending drive concept of this invention, and using the bending drive of this invention, workpieces can be bent in different directions (left/right bending).

BRIEF DESCRIPTION OF THE DRAWINGS

The following description of an embodiment will explain this present invention in detail with reference to the attached diagrammatic illustrations in which.

DETAILED DESCRIPTION OF THE PREFERRED EMBODIMENT

Figure 1:
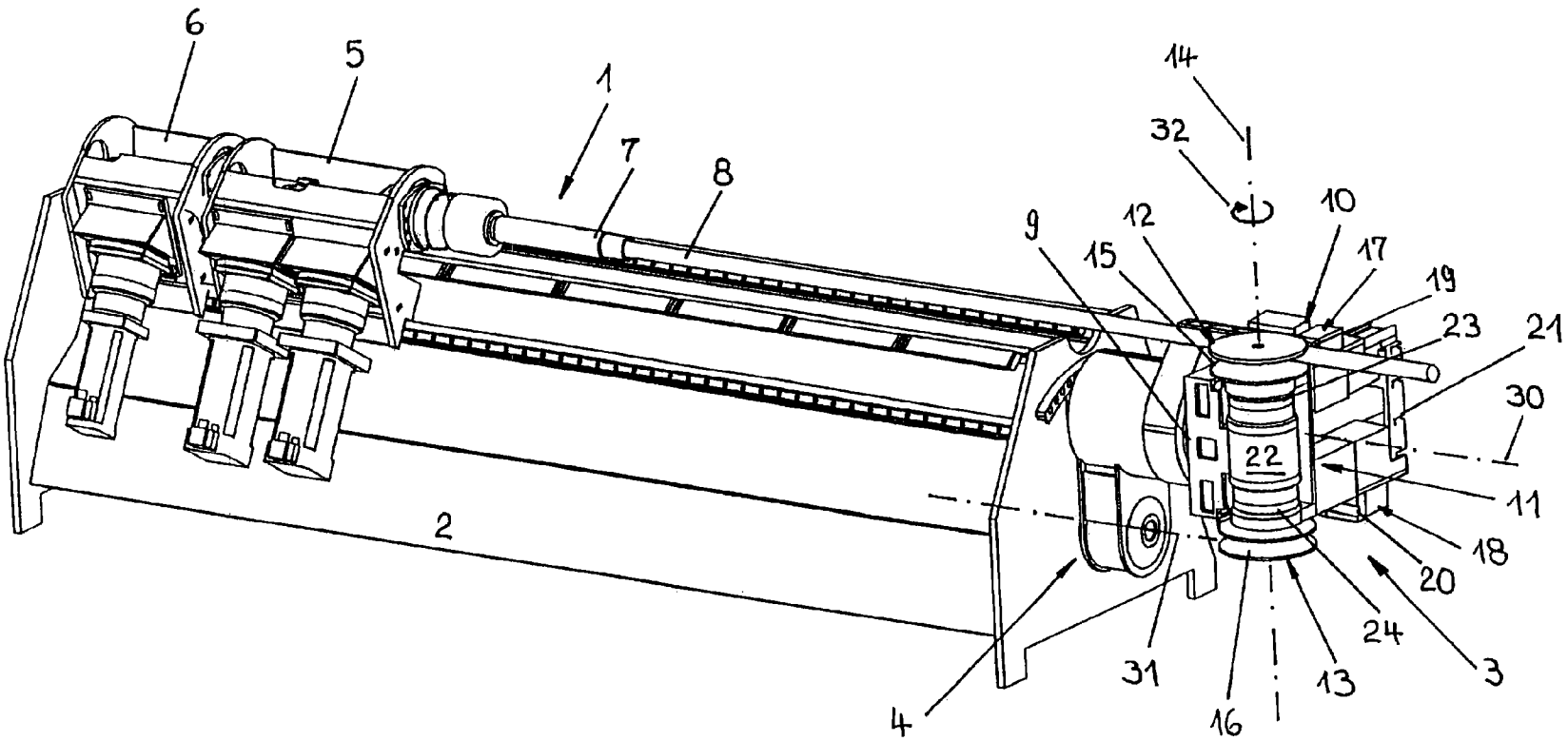
FIG. 1 is al perspective view of a bending machine with a bending assembly embodying the present invention.

As shown in FIG. 1, a bending machine generally designated by the numeral 1 is composed of a machine base 2 and a bending assembly generally designated by the numeral 3 having a bending head that is mounted on a cantilever generally designated by the numeral 4 on the front face of the machine base 2. On its top surface the machine base 2 supports a workpiece feed carriage 5 as well as a mandrel retraction carriage 6. The workpiece feed carriage 5 is provided with a conventional chuck 7 that holds a pipe 8 in the illustrated machine.

Attached to the mandrel retraction carriage 6 is a mandrel bar, (obscured in the drawing) that extends in usual fashion through the workpiece feed carriage 5, the chuck 7 and the pipe 8, and it is equipped at its end spaced from the mandrel retraction carriage 6 with a bending mandrel. The CNC-controlled movement of the workpiece feed carriage 5 and the correspondingly controlled rotation of the chuck 7 position the pipe 8 in its longitudinal direction and its circumferential orientation relative to the bending assembly 3. Again by the CNC-controlled movement of the mandrel retraction carriage 6, the bending mandrel bar inside the pipe 8 can be moved back and forth between a working position and a retracted position.

The bending assembly 3 also includes encompasses a support structure 9 with a bending tool 10 and a bending drive unit 11 that is again CNC-controlled. The bending tool 10 includes workpiece thrust blocks 12, 13 in the form of bending dies that can be rotated around a bending axis 14 extending in a transverse direction relative to the workpiece and provided with circumferential pipe-bending grooves 15, 16. Clamping jaws of the bending tool 10, serving as thrust pads 17, 18, cooperate with the thrust blocks 12, 13. The thrust pads 17, 18 are provided with pipe-bending grooves 19, 20 and can be moved on a swivel arm 21 of the bending drive unit 11 in the transverse workpiece direction.

Apart from the swivel arm 21, the bending drive 11 comprises a torque type bending-drive motor 22 as well as gears 23, 24. By the gears 23, 24, the bending-drive motor 22 drives the workpiece thrust blocks 12, 13 and the swivel arm 21. By means of the bending-drive motor 22, the workpiece thrust blocks 12, 13 can be rotated around the bending axis 14, and the swivel arm 21 with the thrust pads 17, 18 can be swiveled around the bending axis 14.

Figure 2:
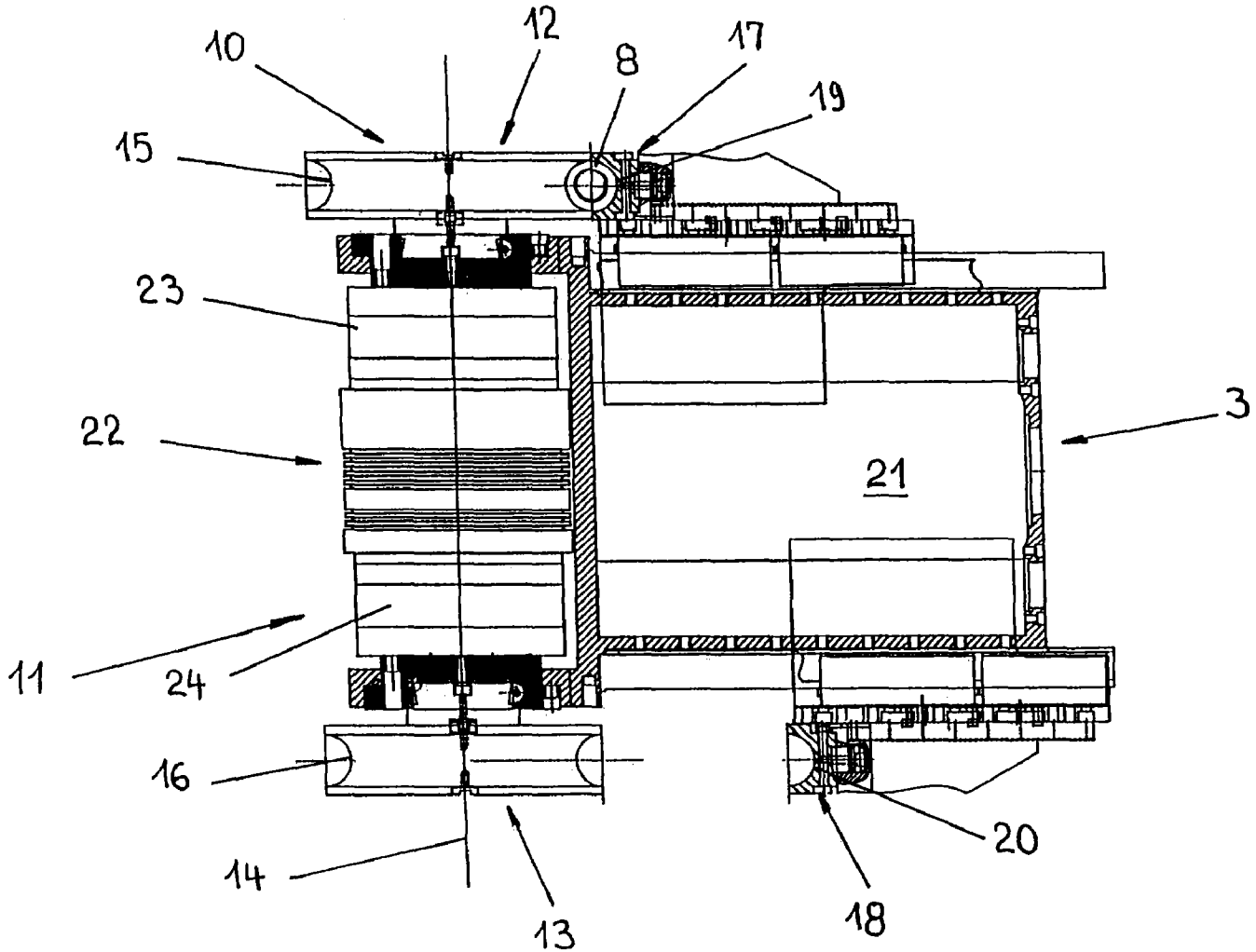
FIG. 2 is a transverse view of the bending assembly of FIG. 1 in partial cross section.
Figure 3:
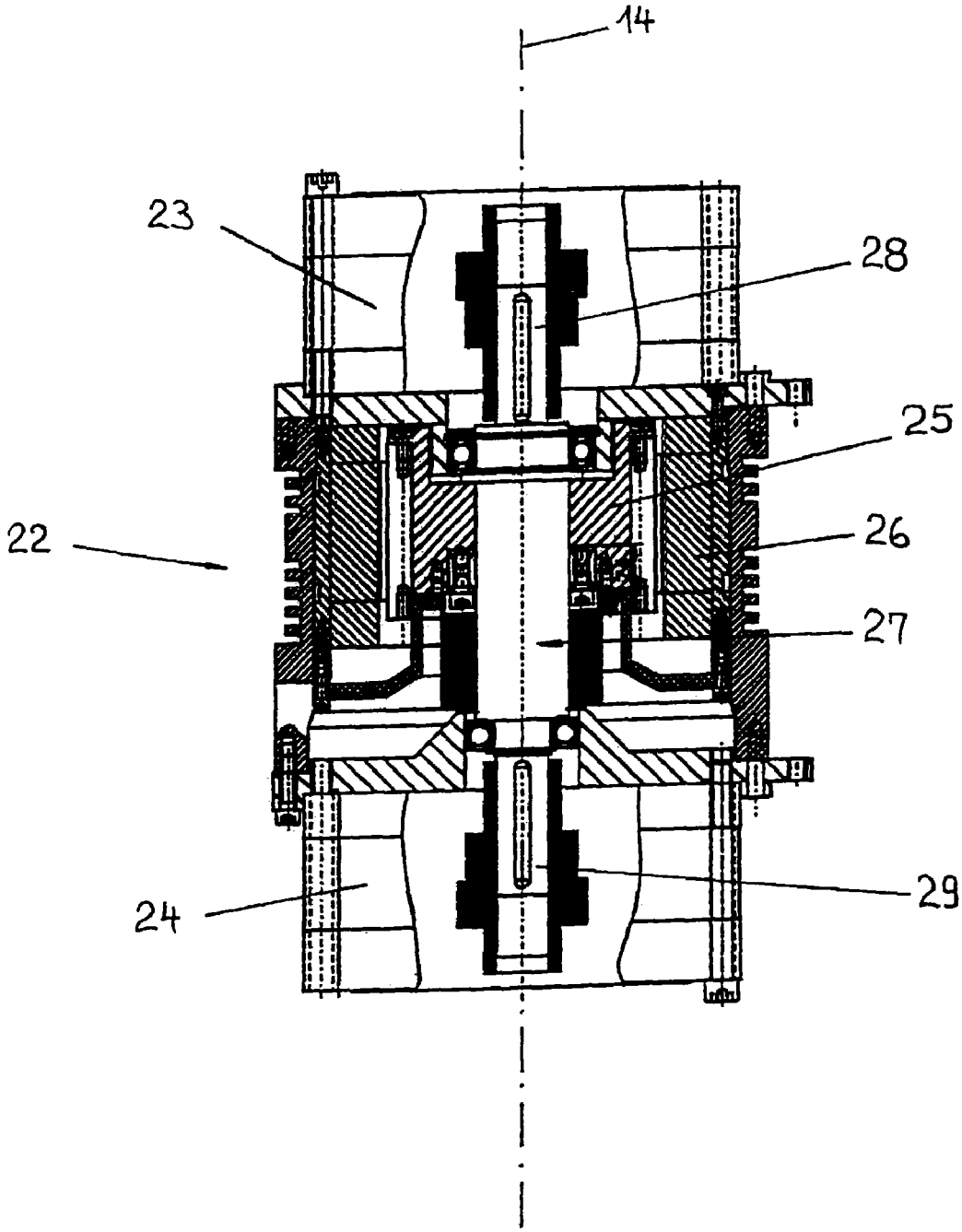
FIG. 3 depicts the bending-drive motor segment of the bending assembly of FIGS. 1 and 2 in partial cross section.

Detailed illustrations of the bending tool 10 are shown in FIG. 2 and of the bending drive 11 in FIGS. 2 and 3.

As depicted in FIG. 3, the bending-drive motor 22 includes a rotor 25, a stator 26 and a motor shaft 27. The geometric axis of the motor shaft 27 coincides with the bending axis 14. Two motor power take-off sides are located at two opposite ends 28, 29 of the motor shaft 27. The shaft end 28 connects to the gear 23, the shaft end 29 connects to the gear 24. On its take-off side, the gear 23 connects to the workpiece thrust block 12 while the gear 24 connects to the workpiece thrust block 13. The swivel arm 21 is attached to the output-side drive element of the gear 23 as well as to the output-side drive element of the gear 24 as shown in FIG. 2. This results in a symmetrical transfer of the power delivered by the bending-drive motor 22 into the swivel arm 21. Since the power transfer is distributed between the two gears 23, 24, these can be relatively small in size.

The complete bending assembly 3 can be rotated around an axis 30 by the support structure 9 on the cantilever 4. The cantilever 4 on its part can be rotated around the axis 31 relative to the machine base 2. The rotational movement of the bending system 3 around the axis 30 and that of the cantilever 4 around the axis 31 is again numerically controlled.

As the first step in the bending process, with the bending tool 10 open, the workpiece feed carriage 5 is moved in the longitudinal direction of the workpiece to place the pipe 8 in the desired position relative to the bending tool 10. By a corresponding movement of the mandrel retraction carriage 6, the bending mandrel inside the pipe 8 is advanced into its working position, whereupon the bending tool 10 is closed. In the example illustrated, this will clamp the pipe 8 between the bending die or workpiece thrust block 12 and the associated clamping jaw or thrust pad 17, resulting in the conditions depicted in FIGS. 1 and 2.

To produce a bend in the pipe, the operating state shown in FIGS. 1 and 2 is followed by rotating the swivel arm 21 with the clamping jaw or thrust pad 17, by activation of the bending-drive motor 22, around the bending axis 14 in the direction of the arrow 32. Coupled with this is a corresponding rotary movement of the bending die or workpiece thrust block 12. This will bend the pipe 8 in the direction of the arrow 32 at the desired angle around the workpiece thrust block 12.

The workpiece thrust block 13 and the associated thrust pad 18 of the bending tool 10 are used if the pipe is to be bent against the direction of the arrow 32. This must be preceded by rotating the bending tool 10 from its position shown in FIG. 1 around the axis 30 and by swiveling the cantilever 4 around the axis 31 so as to align it with the workpiece thrust block 13 and the thrust pad 18 in such fashion that, after the bending tool 10 is closed, the pipe 8 is positioned in the pipe-bending grooves 16, 20 of the workpiece thrust block 13 and of the thrust pad 18. Rotating the swivel arm 21 and turning the workpiece thrust block 13 around the bending axis 14 will then produce the desired bend in the pipe.

For the bending process, the swivel arm 21 will have at its disposal the combined output torque of the gear 23 and of the gear 24. It follows that the bending assembly 3 is capable of delivering sufficient torque for workpiece processing even with small-sized separate gears 23, 24.

In place of the torque motor shown in the drawings as the bending-drive motor 22, it is possible to use other types of motors as well, for example, synchronous motors. Torque motors in particular are suitable for a gearless direct connection of the motor shaft 27 to the workpiece thrust blocks 12, 13 and/or to the swivel arm 21. This deviates from the embodiment shown but is entirely feasible.

Thus, it can be seen from the foregoing detailed description and accompanying drawings that the bending assembly of the present invention is relatively compatible to accommodate high transverse bending torques.

What is claimed is:

1. A bending assembly in a bending machine (1) for bending elongated rod and bar-shaped workpieces (8) comprising (a) a bending tool (10) and (b) a bending drive unit (11) including (c) a swivel arm (21) and (ii) a bending-drive motor (22), said bending tool (10) including (i) at least one workpiece thrust block (12, 13) and (ii) at least one thrust pad (17, 18) on the swivel arm (21), said bending-drive motor (22) being operable to rotate the swivel arm (21) with the thrust pad (17, 18) around a bending axis (14) extending in a direction transversely of the elongated workpiece, whereby the workpiece, forced by the thrust pad (17, 18) against the associated workpiece thrust block (12, 13), can be bent by rotating the swivel arm (21) with the thrust pad (17, 18) around the workpiece thrust block (12, 13), said bending-drive motor (22) having a motor shaft (27) which extends parallel to the bending axis (14) and is drive-connected at both shaft ends (28, 29) to the swivel arm (21).

2. The bending assembly in accordance with claim 1, wherein the motor shaft (27) of the bending-drive motor (22) extends coaxially with the bending axis (14).

3. The bending assembly in accordance with claim 1 wherein the bending-drive motor (22) is a torque motor.

4. The bending assembly in accordance with claim 1 wherein both ends (28, 29) of the motor shaft (27) of the bending-drive motor (22) are individually drive-connected to the swivel arm (21) by a gear unit (23, 24).

5. The bending assembly in accordance with claim 1 wherein at least one workpiece thrust block (12, 13) of the bending tool (10) is a bending die and is drive-connected to the motor shaft (27) of the bending-drive motor (22) and can thus be rotated around the bending axis (14), and wherein the bending tool (10) is equipped with at least one thrust pad (17, 18) in the form of a clamping jaw mounted in the transverse workpiece direction on the swivel arm (21), so that the workpiece can be clamped between the bending die and the associated clamping jaw and bent, while clamped, by rotation of the bending die and of the swivel arm with the clamping jaw around the bending die.

6. The bending assembly in accordance with claim 5 wherein both ends (28, 29) of the motor shaft (27) of the bending-drive motor (22) are respectively drive-connected to at least one bending die which can be rotated around the bending axis (14), the bending dies on the respective shaft ends (28, 29) being positioned in the direction of the bending axis (14) on either side of the bending-drive motor (22), each die cooperating with a clamping jaw that is movable on the swivel arm (21) in a direction transversely of the workpiece, and wherein the bending assembly (3) can be rotated around an axis (30) that extends in a direction of the length of the elongated workpiece, whereby one of the bending dies located on either side of the bending-drive motor (22) and its associated clamping jaw can be selectively moved into a working position.

7. A bending assembly in a bending machine (1) for bending elongated rod and bar-shaped workpieces (8) comprising (a) a bending tool (10) and (b) a bending drive unit (11) including (c) a swivel arm (21) and (ii) a bending-drive motor (22), said bending tool (10) including (i) at least one workpiece thrust block (12, 13) and, (ii) at least one thrust pad (17, 18) on the swivel arm (21), said bending-drive motor (22) being operable to rotate the swivel arm (21) with the thrust pad (17, 18) around a bending axis (14) extending in a direction transversely of an elongated workpiece whereby the workpiece, forced by the thrust pad (17, 18) against the associated workpiece thrust block (12, 13), can be bent by rotating the swivel arm (21) with the thrust pad (17, 18) around the workpiece thrust block (12, 13), said bending-drive motor (22) having a motor shaft (27) which extends parallel to the bending axis (14) and is drive-connected at both shaft ends (28, 29) to the swivel arm (21), said bending drive motor (2) being a torque motor and the motor shaft (27) of the bending-drive motor (22) extending coaxially with the bending axis (14).

8. The bending assembly in accordance with claim 7 wherein both ends (28, 29) of the motor shaft (27) of the bending-drive motor (22) are individually drive-connected to the swivel arm (21) by a gear unit (23, 24).

9. The bending assembly in accordance with claim 7 wherein at least one workpiece thrust block (12, 13) of the bending tool (10) is a bending die and is drive-connected to the motor shaft (27) of the bending-drive motor (22) and can thus be rotated around the bending axis (14), and wherein the bending tool (10) is equipped with at least one thrust pad (17, 18) in the form of a clamping jaw mounted in the transverse workpiece direction on the swivel arm (21), so that the workpiece can be clamped between the bending die and the associated clamping jaw and bent, while clamped, by rotation of the bending die and of the swivel arm with the clamping jaw around the bending die.

10. The bending assembly in accordance with claim 7 wherein both shaft ends (28, 29) of the motor shaft (27) of the bending-drive motor (22) are respectively drive-connected to at least one bending die which can be rotated around the bending axis (14), the bending dies on the respective shaft ends (28, 29) are positioned in the direction of the bending axis (14) on either side of the bending-drive motor (22), each cooperating with a clamping jaw that is movable on the swivel arm (21) in the transverse direction of the workpiece, and wherein the bending assembly (3) can be rotated around an axis (30) that extends in the direction of the length of the elongated workpiece, whereby one of the bending dies located on either side of the bending-drive motor (22) and its associated clamping jaw can be selectively moved into a working position.

* * * * *